US010074503B2

(12) United States Patent
Heid

(10) Patent No.: US 10,074,503 B2
(45) Date of Patent: Sep. 11, 2018

(54) ELECTRON GUN AND RADIATION GENERATING APPARATUS

(71) Applicant: Siemens Aktiengesellschaft, München (DE)

(72) Inventor: Oliver Heid, Erlangen (DE)

(73) Assignee: Siemens Aktiengesellschaft, München (DE)

( * ) Notice: Subject to any disclaimer, the term of this patent is extended or adjusted under 35 U.S.C. 154(b) by 294 days.

(21) Appl. No.: 15/037,971

(22) PCT Filed: Sep. 16, 2014

(86) PCT No.: PCT/EP2014/069663
§ 371 (c)(1),
(2) Date: May 19, 2016

(87) PCT Pub. No.: WO2015/074781
PCT Pub. Date: May 28, 2015

(65) Prior Publication Data

US 2016/0293375 A1 Oct. 6, 2016

(30) Foreign Application Priority Data

Nov. 19, 2013 (DE) ..... 10 2013 223 517

(51) Int. Cl.
*H01J 35/06* (2006.01)
*H01J 3/02* (2006.01)
(Continued)

(52) U.S. Cl.
CPC ..... *H01J 3/027* (2013.01); *H01J 3/02* (2013.01); *H01J 3/18* (2013.01); *H01J 35/06* (2013.01); *H01J 35/14* (2013.01)

(58) Field of Classification Search
CPC .. H01J 35/00; H01J 35/14; H01J 35/06; H01J 35/02; H01J 35/04; H01J 35/065;
(Continued)

(56) References Cited

U.S. PATENT DOCUMENTS 2,842,703 A 7/1958 Preist
3,430,091 A 2/1969 Davis
(Continued)

FOREIGN PATENT DOCUMENTS

CN 1954402 A 4/2007
DE 1589006 B1 7/1970
(Continued)

OTHER PUBLICATIONS

European Notice of Allowance for related European Application No. 14772094.0-1556 dated Mar. 13, 2017.
(Continued)

*Primary Examiner* — Jurie Yun
(74) *Attorney, Agent, or Firm* — Lempia Summerfield Katz LLC

(57) ABSTRACT

The invention relates to an electron gun for generating a flat electron beam, comprising a cathode with an emission surface which is curved about a central axis and which is designed to emit electrons. The electron gun further comprises an accelerating device for accelerating the electrons in a radial direction towards a target region on the central axis. Furthermore, the emission surface has a width in the azimuth direction and a height oriented perpendicularly to the width, said width being at least ten times greater than the height.

17 Claims, 4 Drawing Sheets

(51) Int. Cl.
*H01J 35/14* (2006.01)
*H01J 3/18* (2006.01)

(58) Field of Classification Search
CPC ..... H01J 3/00; H01J 3/02; H01J 3/18; H01J 3/027; H01J 2235/06; H01J 2235/062
USPC ..... 378/119, 121, 122, 136, 138
See application file for complete search history.

(56) References Cited

U.S. PATENT DOCUMENTS

| | | | |
|---|---|---|---|
| 3,980,919 | A | 9/1976 | Bates et al. |
| 4,145,635 | A | 3/1979 | Tuck |
| 5,940,469 | A | 8/1999 | Hell et al. |
| 7,671,522 | B2 | 3/2010 | Lee et al. |
| 2007/0278928 | A1 | 12/2007 | Lee et al. |

FOREIGN PATENT DOCUMENTS

| | | | |
|---|---|---|---|
| DE | 2334106 | A1 | 1/1975 |
| DE | 2747266 | A1 | 5/1978 |
| DE | 4209226 | A1 | 9/1993 |
| DE | 19639243 | A1 | 4/1998 |
| DE | 102009038687 | A1 | 3/2011 |
| JP | H05174761 | A | 7/1993 |
| WO | WO0106632 | A2 | 1/2001 |
| WO | WO2015058971 | A1 | 4/2015 |

OTHER PUBLICATIONS

Chinese Office Action for related Chinese Application No. 201480063212.2 dated Nov. 18, 2016.

European Search Report for related European Application No. 14772094.0 dated Nov. 30, 2016, with English Translation.

German Search Report for related German Application No. 10 2013 223 517.8 dated Mar. 26, 2014, with English Translation.

PCT International Search Report and Written Opinion of the International Searching Authority dated Jan. 23, 2015 for corresponding PCT/EP2014/069663.

ELECTRON GUN AND RADIATION GENERATING APPARATUS

This application is the National Stage of International Application No. PCT/EP2014/069663, filed Sep. 16, 2014, which claims the benefit of German Patent Application No. DE 10 2013 223 517.8, filed Nov. 19, 2013. The entire contents of these documents are hereby incorporated herein by reference.

BACKGROUND

The present embodiments relates to an electron gun.

An electron gun generally has a cathode for emitting free electrons, which are subsequently accelerated by an electron-optical system. Devices that concentrate the electrons to form a directional beam and focus the directional beam onto a target region may also be present. By way of example, electrostatic lenses or magnetic fields are used for this purpose. In the case of electron beams of high current density, the minimum achievable focus size is emitted by the mutual repulsion of the electrons within the beam.

SUMMARY AND DESCRIPTION

The scope of the present invention is defined solely by the appended claims and is not affected to any degree by the statements within this summary.

The present embodiments may obviate one or more of the drawbacks or limitations in the related art. For example, an improved electron gun is provided.

According to one or more of the present embodiments, an electron gun for generating a flat electron beam includes a cathode having an emission surface that is curved about a central axis and is configured to emit electrons. The electron gun also includes an accelerating device for radially accelerating the electrons in the direction of a target region on the central axis. The emission surface has a width in the azimuthal direction and a height oriented perpendicularly to the width. The width is at least ten times the magnitude of the height. Width and height are defined in each case along the emission surface. The azimuthal or width direction denotes the direction in which the emission surface has the curvature about the central axis.

The configuration of the emission surface of the cathode according to one or more of the present embodiments makes it possible to generate a flat electron beam having a large width-to-thickness ratio. In this case, the thickness of the beam is defined perpendicular to the width direction and perpendicular to a beam direction. Since the flat electron beam may change direction during the acceleration, the beam direction always refers to the local average direction of movement of the electrons. Such a flat beam may advantageously be well focused in the thickness direction, which enables the generation of a very fine focal line.

In addition, in the case of flat beams for focusing in the thickness direction, a smaller electron-optical reduction is compared with in the case of round beams having the same cross-sectional area. As a result of this, the requirements made of the electron-optical quality of a lens for focusing in this direction become less stringent. This may make it possible to focus purely electrostatically and to dispense with complicated magnetic lenses. The simplification of the gun construction that is thus achievable reduces the cost expenditure during manufacture and maintenance. A focusing of the beam in the width direction is supported by the curved emission surface and the radial acceleration, which cause the emitted electrons already in the electron gun to converge toward the target region.

In one embodiment, the accelerating device is configured to deflect the electrons in the thickness direction. As a result, the electron gun enables a beam guidance that is not restricted to a plane.

In accordance with a further embodiment, the accelerating device is also configured to focus the flat electron beam in the thickness direction. This advantageously enables the generation of a focused flat electron beam.

In accordance with a further embodiment, the width of the emission surface is at least one hundred times (e.g., at least one thousand times) greater than the height of the emission surface. Given a constant total current and constant height of the emission surface, a larger width leads to a reduction of the current density and thus of the space charge forces at the cathode. Since space charge forces particularly in the regions in which the flat electron beam is slow have a great influence on the beam quality, an improvement in the emittance of the beam may advantageously be achieved by a lower space charge density at the cathode.

In accordance with a further embodiment, the emission surface of the cathode is configured as a closed ring. As a result, the cathode has in the width direction no edge surfaces with leakage fields that may bring about a deflection of the flat electron beam. The space charge forces compensate for one another to an individual electron in the width direction, such that a radial beam guidance is significantly facilitated.

In accordance with an embodiment, a beam direction in the target region does not point toward the emission surface of the cathode. This makes it possible (e.g., in the case of a ring-shaped embodiment of the emission surface) to prevent electrons that traverse the target region along the relevant beam direction from impinging on the emission surface again. The emission surface may otherwise be damaged by heating or electron-induced adsorption of impurity atoms.

In accordance with a further embodiment, a beam direction at the location of the cathode is not perpendicular to the central axis. As an alternative or in addition thereto, in accordance with another embodiment, a beam direction in the target region is not perpendicular to the central axis. This likewise makes it possible to prevent electrons that leave the cathode and/or transverse the target region along the relevant beam direction from impinging on an opposite part of the emission surface.

In accordance with a further embodiment, an edge surface of an electrode of the accelerating device is configured as a segment of a surface of revolution. The axis of rotation of the surface is oriented parallel to the central axis. This enables a particularly simple and compact embodiment of the accelerating device for radially accelerating the electrons in the direction of the target region on the central axis.

In accordance with a further embodiment, the surface of revolution segment that forms an edge surface of an electrode includes a rotation angle of three hundred and sixty degrees. This enables a compact and simple design of the accelerating device, particularly, but not exclusively, if all edge surfaces of the accelerating device that face the electrons are configured in this way. In addition, leakage fields are avoided at the edge surfaces azimuthally delimiting the surfaces of revolution, which facilitates a beam guidance in a radial direction.

A ring-shaped design of the accelerating device additionally allows the flat electron beam to be focused in the width direction solely by a radial beam guidance onto the target region. In other words, elements that may otherwise be necessary and bring about a focusing in the width direction are obviated, which simplifies the construction of the overall system. As a result of a ring-shaped configuration, a low current density and a reduced space charge effect are realized in a particularly simple manner at the location of the cathode. At the same time, the current density of the electrons in the target region may be high. In accordance with a further embodiment, the accelerating device has a unit for generating a magnetic field. This enables a magnetic deflection of the electrons. Magnetic-field-supported beam guidance and focusing allows electron-optical elements with small imaging aberrations to be realized, which may further reduce the achievable focus size.

In this case, in accordance with a further embodiment, the magnetic field is rotationally symmetrical with respect to an axis aligned parallel to the central axis. As a result, the unit for generating a magnetic field may advantageously be configured particularly simply.

A radiation generating apparatus includes an electron gun of the abovementioned type. A target structure is arranged in the target region of the electron gun. The good focusability of the flat electron beam generated by the electron gun enables a high current density on the target structure and thus, for example, a high intensity of the generated radiation.

In accordance with one embodiment of the radiation generating apparatus, the target structure is configured as an x-ray target. A particularly compact x-ray source of high intensity may be realized as a result.

In accordance with a further embodiment of the radiation generating apparatus, the accelerating device of the electron gun is configured to accelerate the electrons to an energy of at least 25 keV (e.g., to an energy of at least 100 keV). This enables a particularly efficient generation of short-wave x-ray light.

DETAILED DESCRIPTION

Figure 1:
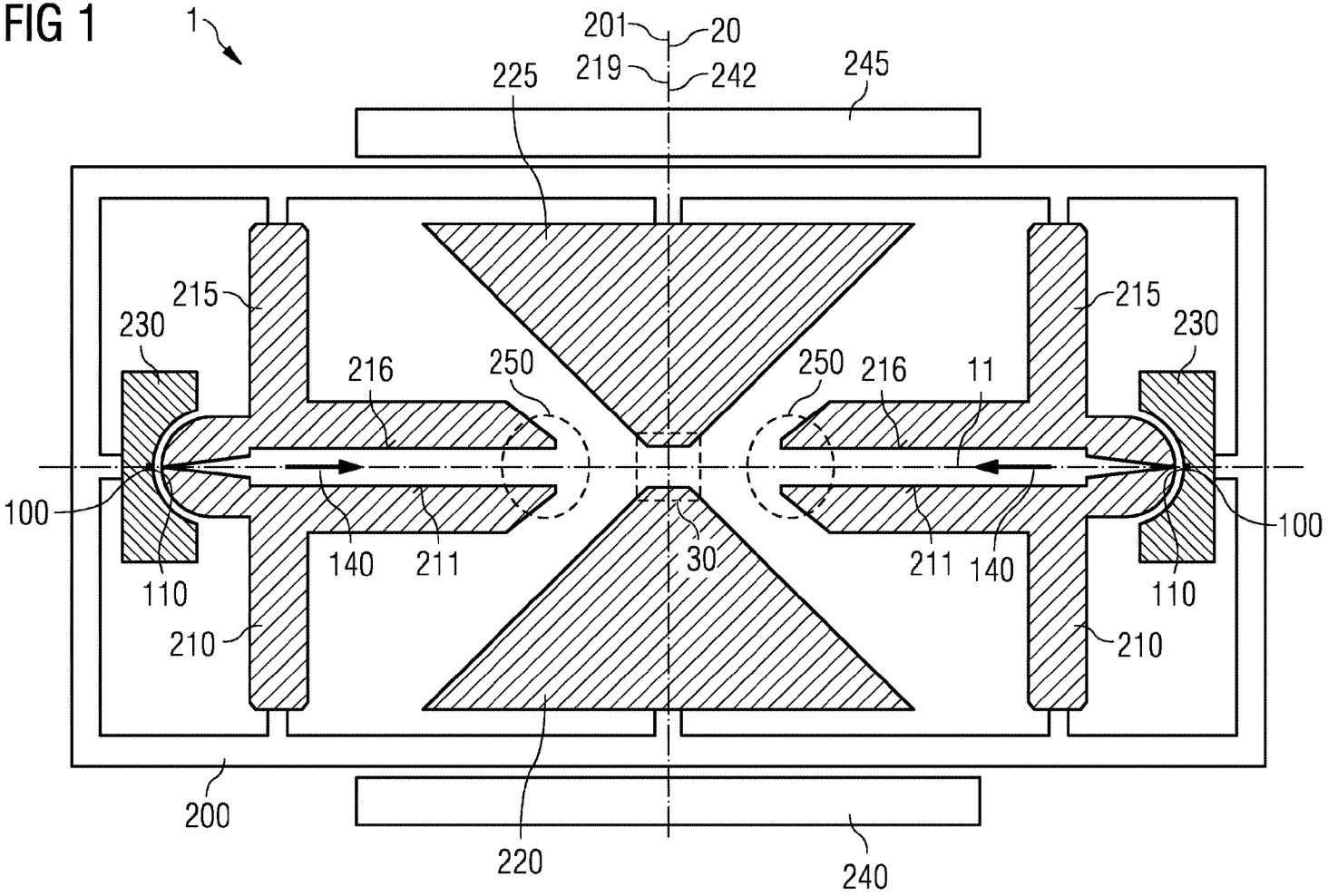
FIG. 1 shows an overall view of a cross section of one embodiment of an electron gun.

FIG. 1 schematically illustrates a sectional view of one embodiment of an electron gun 1. The electron gun 1 allows a flat electron beam to be generated and the flat electron beam to be focused both in a thickness direction and in a width direction. While a focusing in the thickness direction is realized by electron-optical elements, a focusing in the width direction is achieved by a radial beam guidance. For this purpose, all elements of this exemplary embodiment are arranged rotationally symmetrically about a central axis 20. In addition to the rotational symmetry, the entire construction has a mirror symmetry with respect to a centrally arranged beam plane 11.

The electron gun 1 illustrated includes a ring-shaped cathode 100 and an accelerating device 200 (e.g., an accelerator). In this case, the cathode 100 has an emission surface 110 that is positioned on an inner surface of the cathode 100 and is aligned in the direction of the central axis 20. The accelerating device 200 includes a likewise ring-shaped cathode electrode 230 that surrounds the outer side of the cathode 100. The accelerating device 200 also includes a lower lens electrode 210 and an upper lens electrode 215, which are arranged between the cathode 100 and the central axis 20. The accelerating device 200 includes a lower anode element 220 and an upper anode element 225.

The cathode 100 is configured as a body of revolution having an axis 101 of rotation, and the elements of the accelerating device 200 are configured as bodies of revolution having a common axis 201 of rotation. In the embodiment illustrated, the axes 101, 201 of rotation of cathode 100 and accelerating device 200 coincide with the central axis 20. However, embodiments in which two or all three axes do not lie on top of one another, but rather are only arranged parallel to one another may also be provided. Likewise, the individual elements 210, 215, 220, 225, 230 of the accelerating device 200 may have differently arranged axes of rotation.

In the case of the electron gun 1 illustrated, the cathode 100 and the cathode electrode 230 form an outer ring around the central axis 20. The likewise ring-shaped lens electrodes 210, 215 are arranged concentrically inside the ring. In this case, the lower lens electrode 210 and the upper lens electrode 215 lie symmetrical with respect to one another on a respective side of the beam plane 11. Electrons emitted by the emission surface 110 of the cathode 100 move along the beam plane 11 in the interspace between the lens electrodes 210, 215 radially inward toward a target region 30 situated in the center of the electron gun 11 on the central axis 20.

Figure 2:
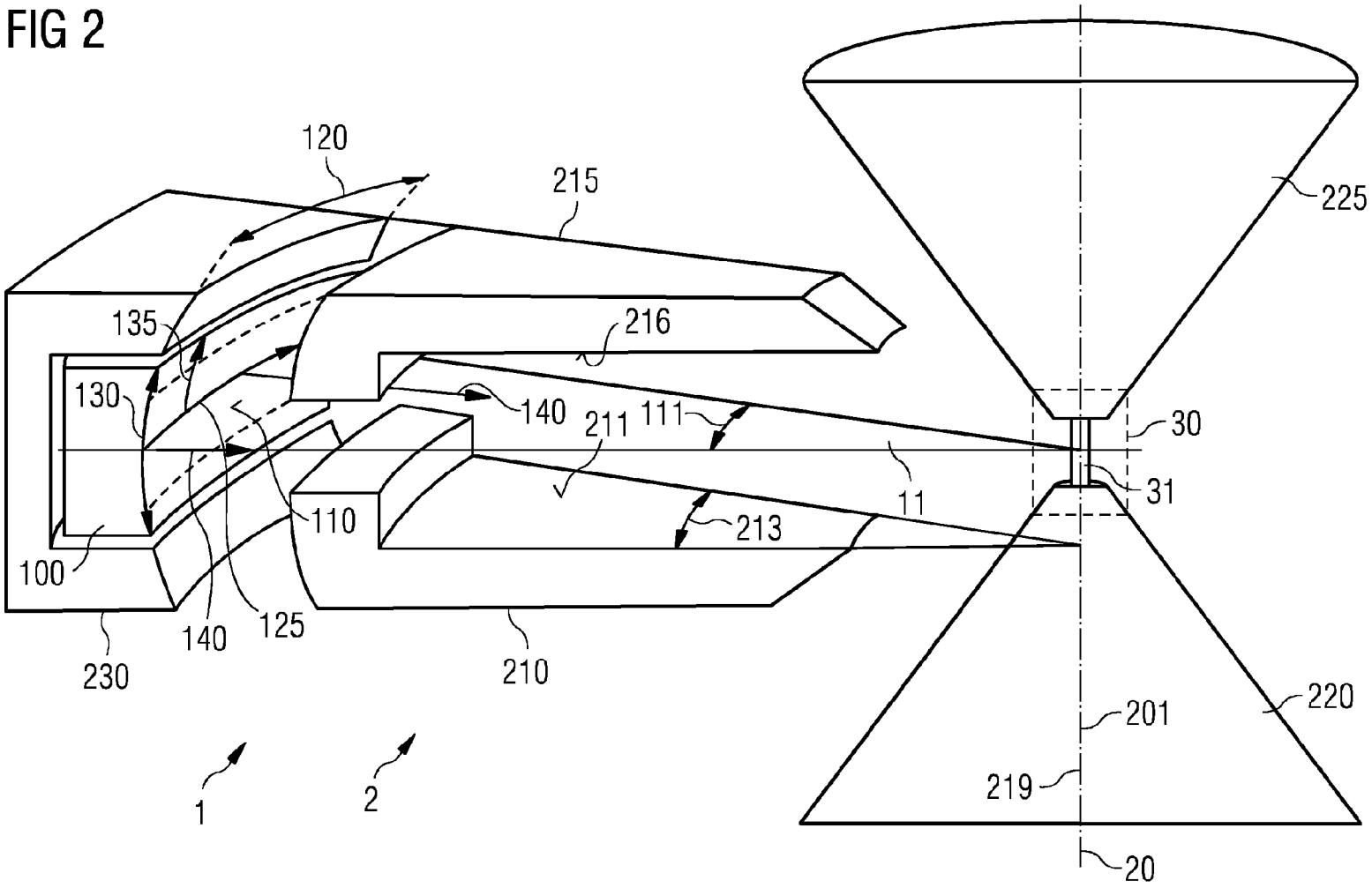
FIG. 2 shows a perspective illustration of a segment of one embodiment of an electron gun.

The lower anode element 220 and the upper anode element 225, which are both configured in a conical fashion, are also arranged inside the ring. Like the lens electrodes 210, 215, the lower anode element 220 and the upper anode element 225 lie symmetrically with respect to one another on opposite sides of the beam plane 11, such that accelerated electrons may traverse the resulting interspace along the beam plane 11. For better illustration of, for example, the configuration of the cathode 100, FIG. 2 shows a perspective schematic illustration of a segment of the electron gun 1. Owing to the rotationally symmetrical embodiment of the lens electrodes 210, 215, the surfaces of the electrodes form surfaces of revolution. In the illustrated exemplary embodiment of the electron gun 1, the electrons move, for example, along an edge surface 211 of the lower lens electrode 210 and an edge surface 216 of the upper lens electrode 215.

The emission surface 110 of the cathode 100 has a width 120 that is at least ten times greater than a height 130 measured perpendicularly to the width 120 along the emission surface. Width and height are defined in each case along the emission surface 110. An azimuthal or width direction 125 denotes the direction in which the emission surface 110 has the curvature about the central axis 20. In general, the curvature of the emission surface 110 along the width direction 125 need not be constant. Besides a curvature along the width direction 125 governed by the ring shape, the emission surface 110 in the exemplary embodiment illustrated also has a curvature along the height 130.

In this case, the emission surface 110 by definition includes the region of the surface of the cathode 100 by which electrons are guided as far as the target region 30 on account of the configuration of the electron gun 1. For example, the emission surface 110 may also be defined by a diaphragm that is arranged between the cathode 100 and the target region 30 and delimits the emitted beam.

Figure 3:
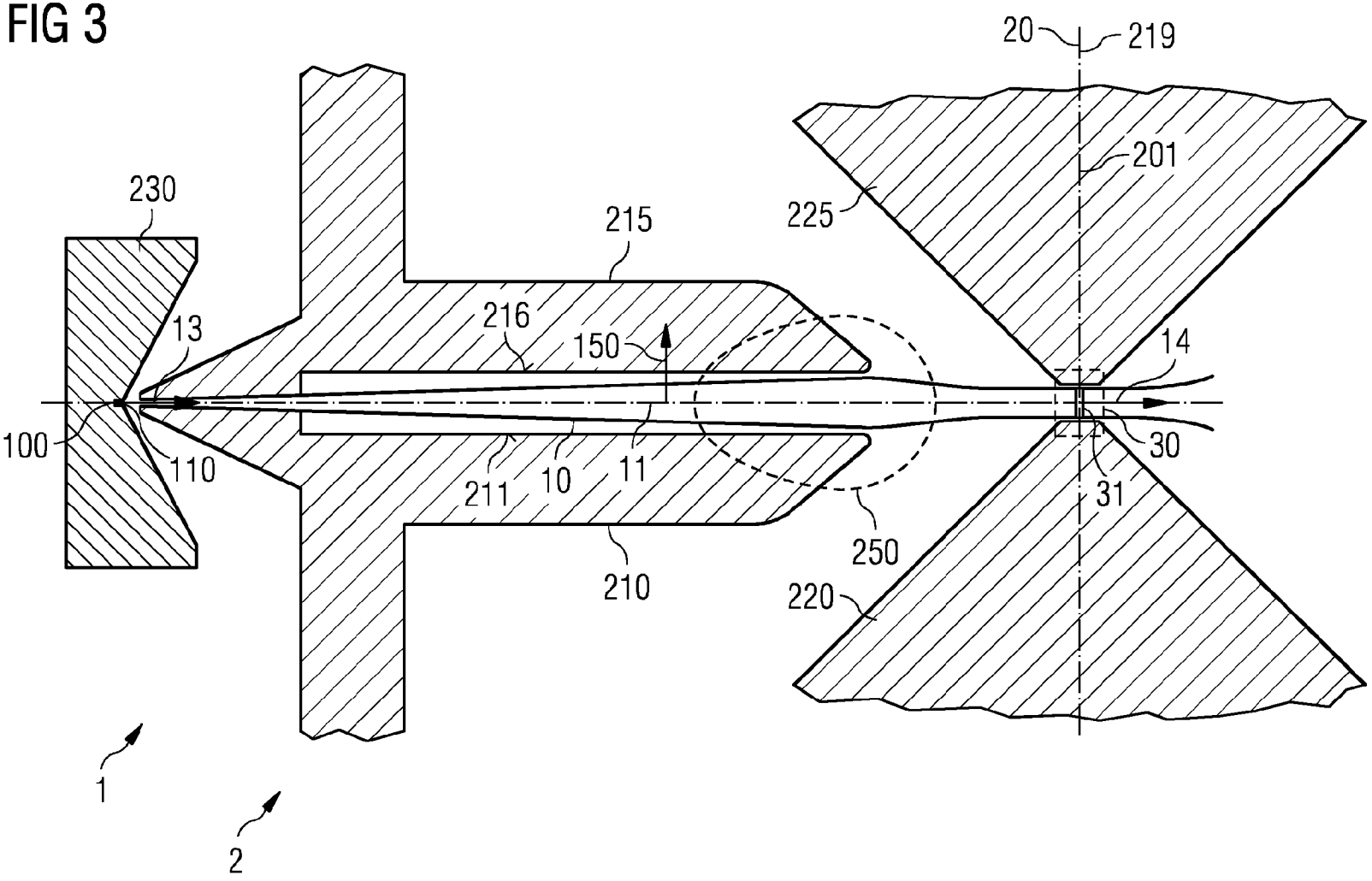
FIG. 3 shows a detail view of a cross section of one embodiment of an electron gun having a ring-shaped emission surface and an accelerating device.

FIG. 3 shows a further illustration of the electron gun 1, in which a generated flat electron beam 10 is also illustrated by way of example, in cross section.

The cathode 100 and the lower and upper lens electrodes 210, 215, respectively, are arranged such that emitted electrons at each location of the emission surface 110 may be accelerated in a respective radial direction 140 toward the target region. For this purpose, the cathode 100 and the lens electrodes 210, 215 are also configured such that a negative voltage with respect to the lens electrodes 210, 215 may be applied to the cathode 100. As a result of the radial acceleration, a disk-shaped flat electron beam 10 arranged symmetrically about the beam plane 11 forms during the operation of the electron gun 1.

Electrons that, in a focusing region 250, emerge again from the region between the lens electrodes 210, 215 are subsequently accelerated further to the desired final velocity in the target region 30. For this purpose, an electrical voltage may likewise be applied between the anode elements 220, 225 and the lens electrodes 210, 215. The inner edge surfaces of the lens electrodes 210, 215 and the edge surfaces of the anode elements 220, 225 are shaped such that an electric field forms upon voltage allocation in a focusing region 250. In the electric field, the flat electron beam 10 is focused in a thickness direction 150 oriented parallel to the central axis 20 at every location in the embodiment shown.

An exemplary voltage allocation for obtaining the schematically depicted beam profile at a beam energy of 25 keV to 200 keV is, relative to the cathode potential, a voltage of 25 kV to 200 kV on the anode elements 220, 225. Approximately one fifth of the anode voltage is then applied to the lens electrodes 210, 215 (e.g., approximately 5 kV to 40 kV). In embodiments, 50 kV or 100 kV is applied to the anode elements 220, 225, and 10 kV or 20 kV is applied to the lens electrodes 210, 215. A beam energy of 25 keV to 200 keV constitutes, for example, an expedient energy range for generating x-ray light in which an x-ray spectrum suitable for medical applications, for example, is generated in conventional x-ray targets. For focusing the flat electron beam 10 onto the target region 30, two different methods are employed in the width direction 125 and the thickness direction 150. In the thickness direction 150, the flat electron beam is focused by an electrostatic lens. For focusing in the width direction 125, by contrast, a beam guidance aligned with the target region 30 radially inward is used as a result of the geometry of the electron gun 1. As a result of this, deflection of the electrons in the width direction 125 is not required.

The rotationally symmetrical embodiment of the electron gun 1 as shown in FIGS. 1 to 3 has the advantage that the space charge forces generated by the mutual repulsion of the electrons of the flat electron beam 10 in the width direction 125 compensate for one another. As a result, the flat electron beam 10 may be focused very finely not only in the thickness direction 150, but also in the width direction 125. The remaining radial component of the space charge has a negligible effect on the achievable focus size.

As a result of the rotationally symmetrical embodiment, moreover, the fields generated by the cathode 100 and the accelerating device 200 in the width direction 125 are homogeneous and are dependent only on the radial distance between the electrons and the central axis 20. Therefore, no marginal fields that may lead to a deflection of the beam occur in the width direction 125.

The electron gun 1 illustrated in FIGS. 1 to 3 enables a large emission surface 110 in the edge region of the electron gun 1 and thus a low electron density at the locations in which the electrons are still slow. This has an advantageous effect on the beam quality, since space charges influence the beam quality particularly in the regions in which the resulting forces may accelerate the electrons to velocities comparable with the longitudinal velocity of the beam. A critical density for space charge effects is attained by the flat electron beam 10 only in proximity to the target region 30, where such a high density is desired and the electrons are so fast that space charge forces are only of secondary importance. Despite the use of a flat electron beam, an isotropic beam shape in the target region 30 may be achieved as a result of the illustrated beam guidance in the radial direction 140.

The flat beam shape additionally allows small focus points to be achieved in the target region 30 with a moderate electron-optical reduction. The requirements made of the imaging quality of the electron lens formed by the electric field in the focusing region 250 become less stringent as a result. For example, it is possible to use purely electrostatic lenses having comparatively large spherical aberrations, and complex lens forms, such as magnetic immersion lenses, for example, may be dispensed with.

The advantages achieved by a large width-to-height ratio of the emission surface 110 are pronounced when the width 120 is at least one hundred times (e.g., at least one thousand times) greater than the height 130. For comparison, for example, an emission surface area of 30 $mm^2$ requires a round cathode having a diameter of approximately 6 mm A perveance of 2* 10^-6 A/V^(3/2) results in a minimum primary focus of approximately 0.6 mm. In order then to realize a focal spot of 50 μm, an electron-optical reduction of one to twelve is to be provided. By contrast, an emission surface area of the same size may be realized by a 300 mm wide and 100 μm high ring-shaped strip. The required reduction ratio in the thickness direction 150 is then only one to two and may be achieved using electrostatic lenses.

The illustrated closed arrangement of the emission region 110 around the target region 30 and the configuration of the anode elements 220, 225 as cones in the center are only one possible variant. For example, the anode elements 220, 225 may likewise be placed in a ring-shaped fashion around the target region 30. The lens electrodes 210, 215, for example, may also be dispensed with, such that the accelerating device 200 consists only of the cathode electrode 230 and the anode elements 220, 225. A focusing of the flat electron beam 10 may then be achieved by a suitable shaping of the electrode surfaces.

Likewise, the accelerating device 200 may include more electrodes than the cathode electrode 230, the lens electrodes 210, 215, and the anode elements 220, 225. In this regard, for example, a separate embodiment of electrodes that extract the electrons from the cathode and electrodes that focus the flat electron beam 10 may be provided. Instead of the shown separate embodiment of the cathode electrode 230, the cathode electrode 230 may also be combined with the cathode 100 to form a single element.

Depending on the configuration of the cathode 100 and diaphragm elements possibly arranged downstream, there may also be more than just one emission surface 110. The height 130 along the width direction 125 and the width 120 along a height direction 120 may be varied instead of keeping the width 120 constant, as illustrated in the figures.

The electrode surfaces facing the flat electron beam 10 (e.g., a surface 211 of the lower lens electrode 210 and/or a surface 216 of the upper lens electrode 215) need not be embodied as surfaces of revolution in order to achieve the desired beam guidance in the radial direction 140. In this regard, further elements such as radial grooves or webs on the electrodes may, for example, be provided in order to enable an additional beam shaping. For this purpose, besides the elements illustrated in FIGS. 1 to 3, additional electrodes and diaphragms may also be integrated into the electron gun 1. What is to be provided for all these modifications is that the electric field that arises when voltage is applied to the electrodes still enables a beam guidance in a primarily radial direction 140.

In the exemplary embodiments shown, both the cathode 10, the cathode electrode 230, and also the lens electrodes 210, 215 and the anode elements 220, 225 are configured as bodies of revolution. However, a segmented configuration in which, for example, the emission surface of the cathode 110 and/or one or more edge surfaces of the lower lens electrode 210 and/or one or more edge surfaces of the upper lens electrode 216 are configured merely as segments of a surface of revolution may also be provided. In this case, the segments include, for example, only ninety or one hundred and eighty degrees instead of the three hundred and sixty degrees shown in FIGS. 1 and 3. In one embodiment, an axis 219 of rotation of the corresponding edge surfaces is oriented parallel to the central axis 20 or, for example, coincides with the central axis 20.

This embodiment corresponds with the schematic illustration in FIG. 2, where the electrodes consist exclusively of the segments illustrated. Depending on an aperture angle 213 of the surface of revolution segments of the lens electrodes 210, 215 and on an aperture angle 111 of the surface of revolution segment of the emission surface 110, additional edge electrodes may be provided in such an embodiment in order to minimize the influence of leakage fields at the segment edges.

An embodiment of the cathode 100, of the cathode electrode 230, of the lens electrodes 210, 215, and of the anode elements 220, 225 as segments of a body of revolution is also not necessary in order to generate, according to one or more of the present embodiments, a flat electron beam in which a focusing in the width direction 125 is supported by a radially convergent beam guidance. A curved embodiment of the emission surface 110 with a not necessarily constant curvature and a correspondingly large ratio of width 120 and height 130 of the emission surface 110 are sufficient.

In accordance with a further embodiment of the electron gun 1, the accelerating device 200 may also include, besides the lens electrodes 210, 215, a unit for generating a magnetic field 240, 245 that includes, for example, a lower magnetic field generating element 240 and an upper magnetic field generating element 245, which are illustrated in FIG. 1. This allows an additional, velocity-dependent deflection of the electrons. In this case, it may be advantageous for the unit for generating a magnetic field 240, 245 to generate a rotationally symmetrical magnetic field, with an axis 242 of rotation that coincides with the central axis 20. The symmetry of the construction is not disturbed as a result.

The radial beam guidance described may also include a deflection of the flat electron beam 10 in the thickness direction 150, such that the beam no longer runs in the same plane at all points. Such a beam guidance may be achieved, for example, by a suitable configuration of the lens electrodes 210, 215 of the accelerating device 200. For example, a simultaneous deflection and focusing of the beam is also possible in this case.

Figure 4:
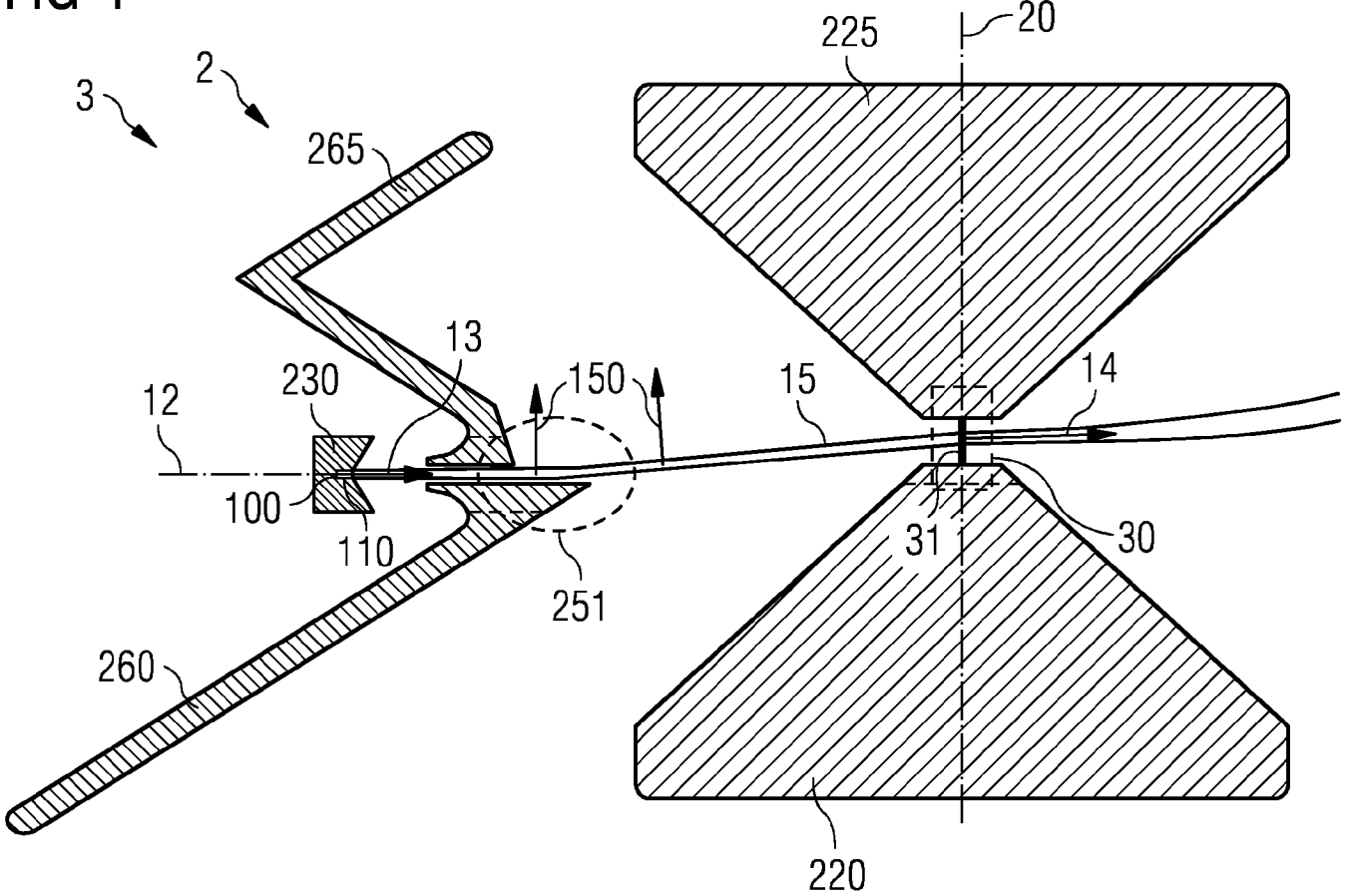
FIG. 4 shows a detail view of a cross section of one embodiment of an electron gun having a ring-shaped emission surface and an accelerating device.

FIG. 4 illustrates with an electron gun 3 a modified embodiment of the electron gun 1 in which the lower lens electrode 210 and the upper lens electrode 215 are replaced by a lower deflection electrode 260 and an upper deflection electrode 265, respectively. These are no longer shaped mirror-symmetrically relative to a beam plane 12 in the cathode region, such that a flat electron beam 15 in the exit region 251 at the end of the deflection electrodes 260, 265 is deflected parallel to the central axis 20. The beam guidance illustrated is characterized, inter alia, in that a beam direction 14 in the target region 30 does not point toward the emission surface 110 of the cathode 100. This prevents emitted electrons, on the side opposite their emission location, from being able to impinge again on a part of the emission surface 110 and contaminating the emission surface 110 there (e.g., by electron beam induced adsorption).

The same aim may also be achieved if the beam direction 14 in the target region 30 is not perpendicular to the central axis 20, but the beam guidance otherwise includes no deflection in the thickness direction 150. A flat electron beam that approximately forms a lateral surface of a cone is generated in this case.

Renewed impingement of the electrons on the emission region 110 may also be prevented by virtue of a beam direction 13 in the region of the cathode 100 not being perpendicular to the central axis 20. After emission, the electrons may then be deflected, for example, by a suitable shaping of and application of voltage to the cathode electrode 230 and/or the lens electrodes 210, 215 and/or additional electrodes into a beam plane perpendicular to the central axis 20 and may subsequently be accelerated further radially inward.

The electron guns 1 or 3 may be embodied as part of a radiation generating apparatus 2 that also includes a target structure 31 arranged in the target region 30. In accordance with one embodiment of the radiation generating apparatus 2, this may involve a target for generating x-ray radiation. Possible materials for such an x-ray target are, for example, tungsten, rhenium-tungsten alloys, molybdenum, copper, or cobalt. The target structure 31 may, for example, have a cylindrical shape and be arranged symmetrically about the central axis 20.

Although the invention has been more specifically illustrated and described in detail by the exemplary embodiments, the invention is not restricted by the examples disclosed. Other variations may be derived therefrom by the person skilled in the art without departing from the scope of protection of the invention.

The elements and features recited in the appended claims may be combined in different ways to produce new claims that likewise fall within the scope of the present invention. Thus, whereas the dependent claims appended below depend from only a single independent or dependent claim, it is to be understood that these dependent claims may, alternatively, be made to depend in the alternative from any preceding or following claim, whether independent or dependent. Such new combinations are to be understood as forming a part of the present specification.

While the present invention has been described above by reference to various embodiments, it should be understood that many changes and modifications can be made to the described embodiments. It is therefore intended that the foregoing description be regarded as illustrative rather than limiting, and that it be understood that all equivalents and/or combinations of embodiments are intended to be included in this description.

The invention claimed is:

1. An electron gun for generating a flat electron beam, the electron gun comprising:

a cathode comprising an emission surface that is curved about a central axis and is configured to emit electrons; and an accelerator operable to accelerate the electrons in a radial direction toward a target region on the central axis, wherein the emission surface has a width in an azimuthal direction, and the emission surface has a height oriented perpendicularly to the width, and wherein the width is at least ten times the magnitude of the height.

2. The electron gun of claim 1, wherein the accelerator is configured to deflect the electrons in a thickness direction oriented perpendicularly to a beam direction and perpendicularly to a width direction.

3. The electron gun of claim 2, wherein the accelerator is configured to focus a flat electron beam in the thickness direction.

4. The electron gun of claim 1, wherein the width of the emission surface is at least one hundred times greater than the height of the emission surface.

5. The electron gun of claim 4, wherein the width of the emission surface is at least one thousand times greater than the height of the emission surface.

6. The electron gun of claim 1, wherein the emission surface of the cathode is configured as a closed ring.

7. The electron gun of claim 1, wherein a beam direction in the target region does not point toward the emission surface of the cathode.

8. The electron gun of claim 1, wherein a beam direction at a location of the cathode is not perpendicular to the central axis.

9. The electron gun of claim 1, wherein a beam direction in the target region is not perpendicular to the central axis.

10. The electron gun of claim 1, wherein an edge surface of an electrode of the accelerator is configured as a segment of a surface of revolution with an axis of the rotation that is oriented parallel to the central axis.

11. The electron gun of claim 10, wherein the surface of revolution segment of the edge surface has a rotation angle of three hundred and sixty degrees.

12. The electron gun of claim 1, wherein the accelerator comprises a magnetic field generator.

13. The electron gun of claim 12, wherein the magnetic field generator is configured to generate a magnetic field configured to be rotationally symmetrical about an axis parallel to the central axis.

14. A radiation generating apparatus comprising:

an electron gun for generating a flat electron beam, the electron gun comprising:

a cathode comprising an emission surface that is curved about a central axis and is configured to emit electrons; and an accelerator operable to accelerate the electrons in a radial direction toward a target region on the central axis, wherein the emission surface has a width in an azimuthal direction, and the emission surface has a height oriented perpendicularly to the width, and wherein the width is at least ten times the magnitude of the height; and a target structure arranged in the target region.

15. The radiation generating apparatus of claim 14, wherein the target structure is configured as an x-ray target.

16. The radiation generating apparatus of claim 15, wherein the accelerator is configured to accelerate the electrons to an energy of at least 25 keV.

17. The radiation generating apparatus of claim 16, wherein the accelerator is configured to accelerate the electrons to an energy of at least 100 keV.

* * * * *